US009945540B2

(12) United States Patent
Zheng et al.

(10) Patent No.: US 9,945,540 B2
(45) Date of Patent: Apr. 17, 2018

(54) LED WALL LAMP

(71) Applicant: MESTER LED LIMITED, Shenzhen (CN)

(72) Inventors: Shuqiong Zheng, Guangdong (CN); Ping Li, Hunan (CN); Chunjiang Shuai, Guangdong (CN)

(73) Assignee: Mester LED Limited, Shenzhen (CN)

( * ) Notice: Subject to any disclaimer, the term of this patent is extended or adjusted under 35 U.S.C. 154(b) by 0 days.

(21) Appl. No.: 15/247,858

(22) Filed: Aug. 25, 2016

(65) Prior Publication Data

US 2017/0370556 A1 Dec. 28, 2017

(30) Foreign Application Priority Data

Jun. 28, 2016 (CN) ..... 2016 2 0656112 U

(51) Int. Cl.

| | |
|---|---|
| ***F21S 8/00*** | (2006.01) |
| ***F21V 17/10*** | (2006.01) |
| ***F21V 31/00*** | (2006.01) |
| ***F21V 21/30*** | (2006.01) |
| *F21Y 115/10* | (2016.01) |

(52) U.S. Cl.

CPC ..... *F21V 17/107* (2013.01); *F21V 21/30* (2013.01); *F21V 31/005* (2013.01); *F21Y 2115/10* (2016.08)

(58) Field of Classification Search

CPC ..... F21V 17/107; F21V 21/30

See application file for complete search history.

(56) References Cited

U.S. PATENT DOCUMENTS

| | | | | |
|---|---|---|---|---|
| 4,390,114 | A * | 6/1983 | Sviatoslavsky | F21V 17/107 220/4.02 |
| 4,538,217 | A * | 8/1985 | Ewing | F21S 8/033 362/220 |
| 2005/0213351 | A1* | 9/2005 | Yang | B60Q 1/323 362/633 |
| 2014/0293612 | A1* | 10/2014 | Tsao | F21V 29/74 362/297 |

* cited by examiner

*Primary Examiner* — Sean Gramling

(57) ABSTRACT

An LED wall lamp, comprising a radiating metal shell; the radiating metal shell comprises an upper cover for installing a light source module and a lower cover for installing a power module; one side of the upper cover rotationally connects to one side of the lower cover in cooperation with a rotating shaft with a boss through a side slot for locating; the other side of the upper cover connects to the other side of the lower cover in a fastening manner through a screw structure. The LED wall lamp with an outer radiating shell of simpler connection structure, thus, no secondary possessing is needed and the assembly efficiency is higher.

15 Claims, 3 Drawing Sheets

100

LED WALL LAMP

CROSS-REFERENCE TO RELATED APPLICATIONS

The present application claims the benefit of Chinese Patent Application No. 201620656112.7 filed on Jun. 28, 2016, the contents of which are hereby incorporated by reference.

TECHNICAL FIELD

The Invention relates to the field of lighting technology and particularly to an LED wall lamp.

BACKGROUND

It is well known that, as a kind of traditional lamp, the wall lamp has been used in America for over 100 years with the external structure and the installation way unchanged, i.e., the upper and lower covers of the outer radiating shell are mainly assembled through the cooperation between a rotating shaft and a rotating shaft hole. However, it is found that in the actual production process, the way of assembly is not only complicated, but also with higher accuracy on processing the rotating shaft hole and the rotating shaft hole often needs a secondary processing, bringing about low efficiency and high cost.

SUMMARY OF THE INVENTION

The Invention is to provide an LED wall lamp with an outer radiating shell of simpler connection structure, thus, no secondary possessing is needed and the assembly efficiency is higher.

The Invention is achieved as follows:

An LED wall lamp, wherein, the LED wall lamp comprises a radiating metal shell; the radiating metal shell comprises an upper cover for installing a light source module and a lower cover for installing a power module; one side of the upper cover rotationally connects to one side of the lower cover in cooperation with a rotating shaft with a boss through a side slot for locating; the other side of the upper cover connects to the other side of the lower cover in a fastening manner through a screw structure.

As an improvement of the above-mentioned LED wall lamp, the side slot for locating comprises a first arc slot and a second arc slot connected to each other; the size of the first arc slot is larger than that of the second arc slot, allowing the boss to be stuck in the first arc slot and the rotating shaft to be stuck in the second arc slot.

As an improvement of the above-mentioned LED wall lamp, two side slots for locating are arranged alternately on one side of the upper cover; two rotating shafts with bosses adapting to the two side slots for locating are arranged on one side of the lower cover.

As an improvement of the above-mentioned LED wall lamp, two saddles are arranged on one side of the lower cover; a bearing cambered surface adapting to the outer contour of the side slot for locating is arranged on each saddle to support the corresponding side slot for locating.

As an improvement of the above-mentioned LED wall lamp, two side slots for locating are arranged alternately on one side of the lower cover; two rotating shafts with bosses adapting to the two side slots for locating are arranged on one side of the upper cover.

As an improvement of the above-mentioned LED wall lamp, two saddles are arranged on one side of the upper cover; a bearing cambered surface adapting to the outer contour of the side slot for locating is arranged on each saddle to support the corresponding side slot for locating.

As an improvement of the above-mentioned LED wall lamp, a waterproofing silica gel is arranged at the junction between the upper cover and the lower cover.

As an improvement of the above-mentioned LED wall lamp, the light source module comprises an LED light source and an optical diffuser covering the LED light source; the LED light source electrically connects to the power module with a plug structure.

The beneficial effects of the Invention are that: an LED wall lamp provided by the Invention, wherein, one side of an upper cover rotationally connects to one side of a lower cover in cooperation with a rotating shaft with a boss through a side slot for locating, reaching the goals of opening a rotation angle of the radiating metal shell and preventing the upper and lower covers falling off the position through the cooperation between the side slot for locating and the rotating shaft with a boss; the side slot for locating can be formed through die casting in a mold, thus, the upper and lower covers of the radiating metal can be assembled without secondary processing. It is clear that the LED wall lamp has an outer radiating shell of simpler connection structure, thus, no secondary possessing is needed and the assembly efficiency is higher.

BRIEF DESCRIPTION OF THE DRAWINGS

In order to illustrate the technical schemes in the embodiments of the Invention or in prior art more clearly, the drawings required in description of the embodiments or prior art will be introduced briefly as follows. Obviously, the drawings described below are just a part of the embodiments of the Invention. A person skilled in the art is able to obtain other drawings according to these drawings without any creative work.

DETAILED DESCRIPTION OF THE PREFERRED EMBODIMENTS

A clear and full description of the technical schemes of the embodiments of the Invention will be given in combination of the drawings of the embodiments of the Invention as follows. Obviously, the described embodiments are just a part rather than the whole of the embodiments of the Invention. Based on the embodiments of the Invention, any other embodiments obtained by a person skilled in the art without any creative work will fall within the protection scope of the Invention.

Figure 1:
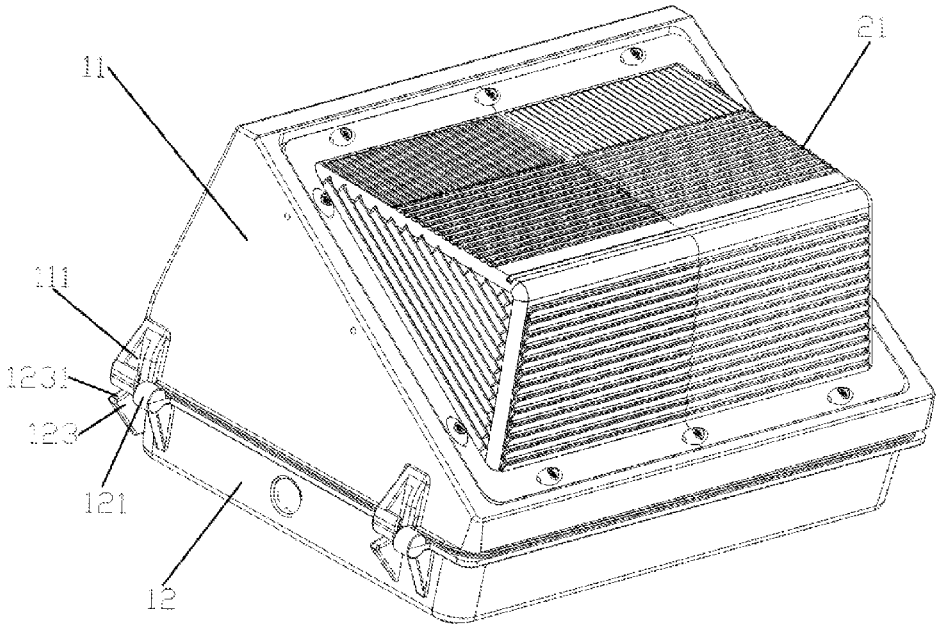
FIG. 1 is an overall structure diagram of a preferred embodiment of the LED wall lamp of the Invention.
Figure 2:
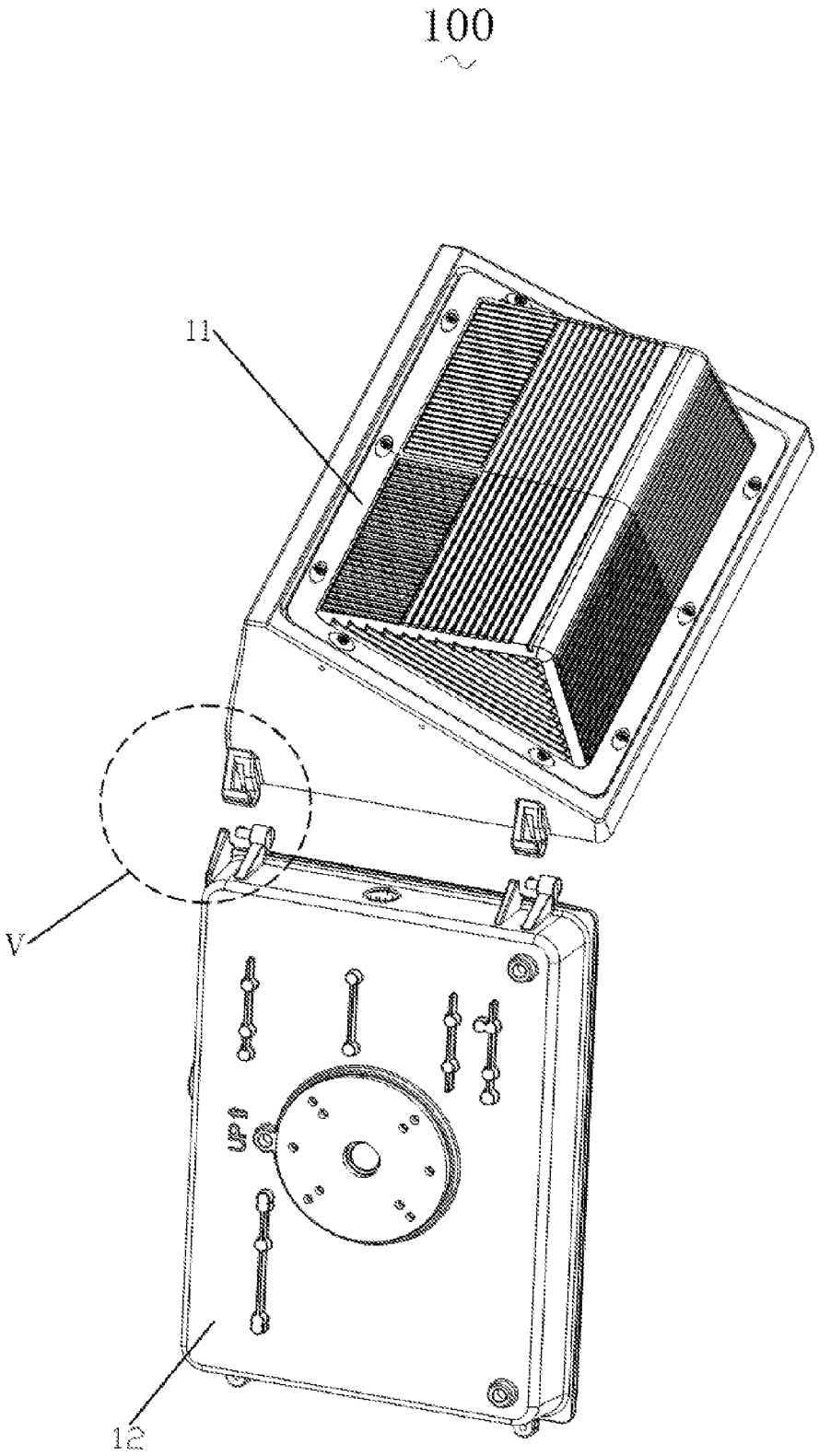
FIG. 2 is a diagram of the breakdown structure of the LED wall lamp shown in FIG. 1.
Figure 3:
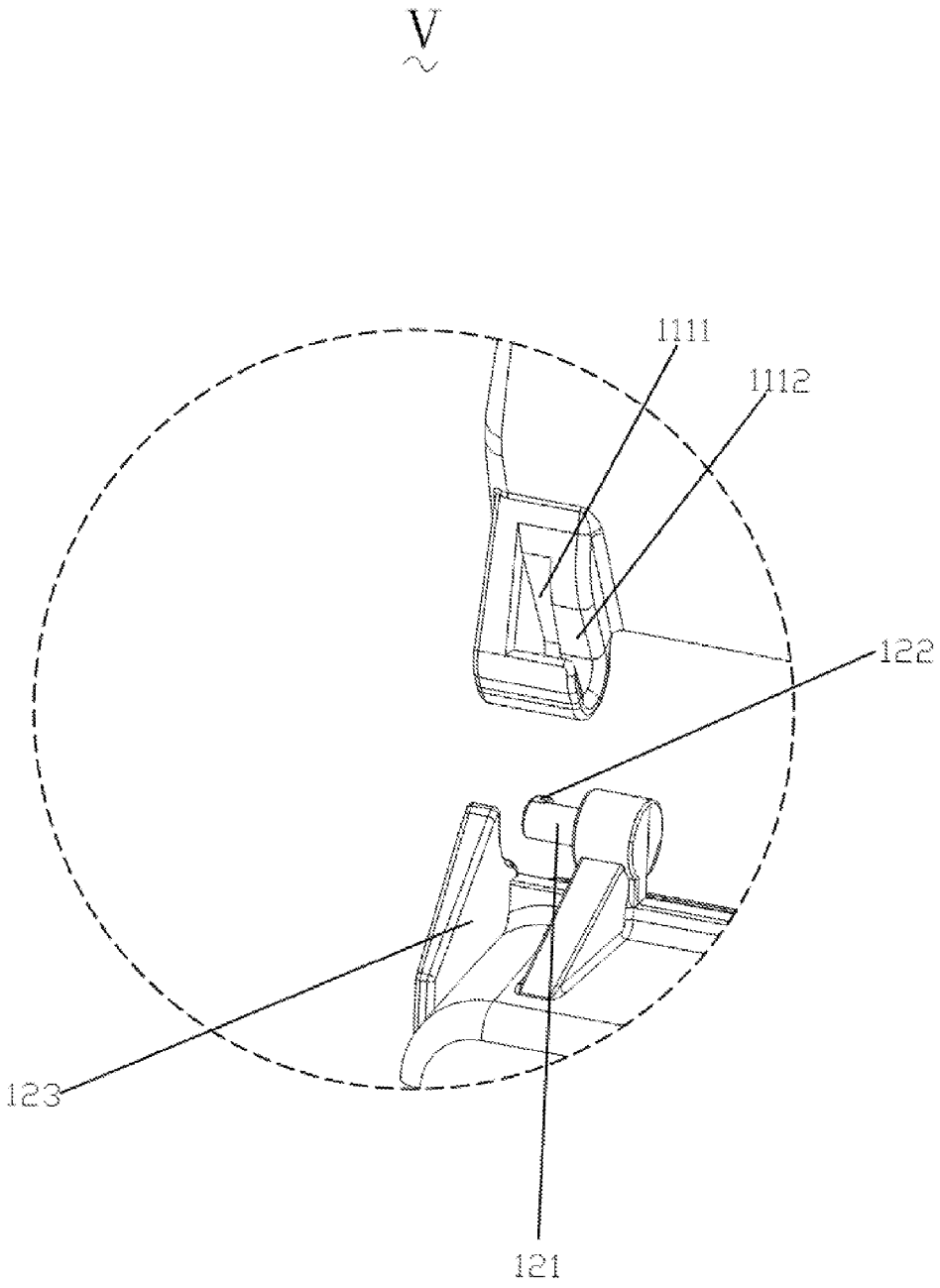
FIG. 3 is a structure diagram of View V-V of the LED wall lamp shown in FIG. 2.

As shown in FIGS. 1-3, the embodiment provides an LED wall lamp 100, including a radiating metal shell; the radiating metal shell includes an upper cover 11 for installing a light source module (not shown in the drawings) and a lower cover 12 for installing a power module (not shown in the drawings); one side of the upper cover 11 rotationally connects to one side of the lower cover 12 through the cooperation between a rotating shaft 121 with a boss 122 and a side slot for locating 111; the other side of the upper cover 11 connects to the other side of the lower cover 12 in a fastening manner through a screw structure (not shown in the drawings).

In the embodiment, as shown in FIGS. 1 and 3, two side slots for locating 111 are arranged alternately on one side of the upper cover 11; two rotating shafts 121 with bosses 122 adapting to the two side slots for locating 111 are arranged on one side of the lower cover 12; particularly, the side slot for locating 111 includes a first arc slot 1111 and a second arc slot 1112 connected to each other; the size of the first arc slot 1111 is larger than that of the second arc slot 1112, allowing the boss 122 to be stuck in the first arc slot 1111 and the rotating shaft 121 to be stuck in the second arc slot 1112. For initial installation of the radiating metal shell, the rotating shaft 121 and the boss 122 on the rotating shaft rotate along the corresponding first arc slot 1111 and the second arc slot 1112 respectively so as to be located into the side slot for locating 111 gradually. Locating will be better realized as the rotation goes on and reaches a maximum angle of 120 degree. In this way of assembly, the upper and lower covers are not likely to fall off during and after the rotation; thus the safety of the product is improved.

As shown in FIGS. 1 and 3, two saddles 123 are arranged on one side of the lower cover 12; a bearing cambered surface 1231 adapting to the outer contour of the side slot for locating 111 is arranged on each saddle to support the corresponding side slot for locating 111. Based on the structure of the saddle 123, it can prevent the radiating metal shell falling off in the very beginning of assembly on one hand, and restrict the final angle opened by rotation of the upper and lower covers of the radiating metal shell on the other hand.

In addition, a waterproofing silica gel (not shown in the drawings) is arranged at the junction between the upper cover 11 and the lower cover 12, enhancing the waterproofness of the radiating metal shell. The light source module includes an LED light source and an optical diffuser 21 covering the LED light source; the LED light source electrically connects to the power module with a plug structure (not shown in the drawings). With design of the plug structure, the upper cover 11 for installing the light source module can be separated from the upper cover 12 for installing the power module quickly.

For the LED wall lamp 100 in the embodiment, the two rotating shafts 121 with bosses 122 are arranged at one side of the lower cover 12, which is a mode of downward rotating shaft; a person skilled in the art can also arrange the two rotating shafts 121 with bosses 122 at one side of the upper cover 11 and arrange the two side slots for locating 111 and the two saddles 123 at one side of the lower cover 12 accordingly to form a mode of upward rotating shaft by inversing the entire direction.

The LED wall lamp provided by the embodiment, wherein, one side of an upper cover 11 rotationally connects to one side of a lower cover 12 through the cooperation between a rotating shaft 121 with a boss and a side slot for locating 111, reaching the goals of opening a rotation angle of the radiating metal shell and preventing the upper and lower covers falling off the position through the cooperation between the side slot for locating 111 and the rotating shaft 121 with a boss; the side slot for locating 111 can be formed through die casting in a mold, thus, the upper and lower covers of the radiating metal can be assembled without secondary processing. It is clear that the LED wall lamp has an outer radiating shell of simpler connection structure, thus, no secondary possessing is needed and the assembly efficiency is higher.

The above are the preferred embodiments rather than the limitations of the Invention. Any amendment, equivalent replacement and improvement made within the range of the spirit and rule of the Invention shall be included in the protection scope of the Invention.

What is claimed is:

1. An LED wall lamp, wherein, the LED wall lamp comprises a radiating metal shell; the radiating metal shell comprises an upper cover for installing a light source module and a lower cover for installing a power module; one side of the upper cover rotationally connects to one side of the lower cover through the cooperation between a side slot for locating and a rotating shaft with a boss; the other side of the upper cover connects to the other side of the lower cover in a fastening manner through a screw structure;

wherein the side slot for locating comprises a first arc slot and a second arc slot connected to each other and open towards a same direction; the size of the first arc slot is larger than that of the second arc slot, the boss being held in the first arc slot and the rotating shaft being held in the second arc slot;

wherein the LED wall lamp further comprises a saddle formed proximate to and spaced apart from the rotating shaft with the boss, a bearing cambered surface adapting to an outer contour of the side slot for locating is arranged on the saddle to support the side slot for locating.

2. The LED wall lamp according to claim 1, wherein, two side slots for locating are arranged alternately on one side of the upper cover; two rotating shafts with bosses adapting to the two side slots for locating are arranged on one side of the lower cover.

3. The LED wall lamp according to claim 2, wherein, two saddles are arranged on one side of the lower cover; two bearing cambered surfaces adapting to the outer contour of two side slots for locating are arranged on the two saddles to support the two side slots for locating respectively.

4. The LED wall lamp according to claim 1, wherein, two side slots for locating are arranged alternately on one side of the lower cover; two rotating shafts with bosses adapting to the two side slots for locating are arranged on one side of the upper cover.

5. The LED wall lamp according to claim 4, wherein, two saddles are arranged on one side of the upper cover; a bearing cambered surface adapting to the outer contour of the side slot for locating is arranged on each saddle to support the corresponding side slot for locating.

6. The LED wall lamp according to claim 1, wherein, a waterproofing silica gel is arranged at the junction between the upper cover and the lower cover.

7. The LED wall lamp according to claim 6, wherein, the light source module comprises an LED light source and an optical diffuser covering the LED light source; the LED light source electrically connects to the power module with a plug structure.

8. The LED wall lamp according to claim 2, wherein, a waterproofing silica gel is arranged at the junction between the upper cover and the lower cover.

9. The LED wall lamp according to claim 3, wherein, a waterproofing silica gel is arranged at the junction between the upper cover and the lower cover.

10. The LED wall lamp according to claim 4, wherein, a waterproofing silica gel is arranged at the junction between the upper cover and the lower cover.

11. The LED wall lamp according to claim 5, wherein, a waterproofing silica gel is arranged at the junction between the upper cover and the lower cover.

12. The LED wall lamp according to claim 8, wherein, the light source module comprises an LED light source and an optical diffuser covering the LED light source; the LED light source electrically connects to the power module with a plug structure.

13. The LED wall lamp according to claim 9, wherein, the light source module comprises an LED light source and an optical diffuser covering the LED light source; the LED light source electrically connects to the power module with a plug structure.

14. The LED wall lamp according to claim 10, wherein, the light source module comprises an LED light source and an optical diffuser covering the LED light source; the LED light source electrically connects to the power module with a plug structure.

15. The LED wall lamp according to claim 11, wherein, the light source module comprises an LED light source and an optical diffuser covering the LED light source; the LED light source electrically connects to the power module with a plug structure.

* * * * *